US005855233A

United States Patent [19]

Bolelli

[11] Patent Number: 5,855,233

[45] Date of Patent: Jan. 5, 1999

[54] PULVERULENT SUBSTANCE DISPENSING DEVICE FOR CAPSULE FILLING MACHINES

[75] Inventor: Emilio Bolelli, Milan, Italy

[73] Assignee: Dott. Bonapace & C.S.R.L., Milan, Italy

[21] Appl. No.: 954,666

[22] Filed: Oct. 20, 1997

[30] Foreign Application Priority Data

Oct. 22, 1996 [IT] Italy ..... M196A 2193

[51] Int. Cl.[6] ..... B65B 43/50

[52] U.S. Cl. ..... 141/144; 141/71; 141/73; 141/81; 141/103; 141/173

[58] Field of Search ..... 141/71, 81, 73, 141/103, 144, 173, 175, 145, 146

[56] References Cited

U.S. PATENT DOCUMENTS

| | | | |
|---|---|---|---|
| 3,554,412 | 1/1971 | Hayashi et al. | 141/144 X |
| 4,949,766 | 8/1990 | Coatsworth | 141/144 X |
| 5,111,642 | 5/1992 | Chiari | 141/71 X |
| 5,240,049 | 8/1993 | Chiari | 141/144 X |
| 5,626,171 | 5/1997 | Mirri | 141/81 X |

FOREIGN PATENT DOCUMENTS

| | | |
|---|---|---|
| 1117471 | 11/1961 | Germany . |
| 1174244 | 7/1964 | Germany . |
| 2346070 | 3/1975 | Germany . |
| 9511658 | 5/1995 | WIPO . |

*Primary Examiner*—David J. Walczak
*Assistant Examiner*—Kathleen J. Prunner
*Attorney, Agent, or Firm*—Steinberg & Raskin, P.C.

[57] ABSTRACT

The dispensing device comprises a powder feeding container (1), an intermittently rotating body (7) provided with a circular channel (6) which receives the powder from the container (1) and is provided in its base with groups (X) of holes (9, 9A) alternately alignable with holes (12, 12A) present in an underlying intermittently rotating forming cylinder, a stationary closure member (10) lying below the rotating body (7) and comprising a series of holes (10B), a movable multiple pusher means (15, 16, 17, 18, 18A) which, when a group (X) of holes of the rotating body (7) become aligned with the holes (10B) of the closure member (10) and with a corresponding number of holes (12, 12A) of the forming cylinder (11), traverses the circular channel (6) and said aligned holes to feed into and compress within the holes (12, 12A) of the forming cylinder (11) given quantities of powder, which said forming cylinder conveys, compressed, into a position coinciding with a capsule base (2) which is aligned with a hole (12) of said forming cylinder (11) and where the multiple pusher means transfers a compacted measure of powder into the capsule base (2), the multiple pusher means comprising three presser members (15, 16, 17) for transferring and compressing the powder, and an expulsion member (18) for transferring the compressed powder mass into the capsule base (2).

7 Claims, 3 Drawing Sheets

PULVERULENT SUBSTANCE DISPENSING DEVICE FOR CAPSULE FILLING MACHINES

FIELD OF THE INVENTION

This invention relates to a dispensing device for pulverulent substances, for example medicinal substances, for capsule filling machines in which it represents one of the operating stations of such machines.

BACKGROUND OF THE INVENTION

In filling machines the capsules, supplied closed by the producer, are orientated with their lid upwards, the capsule lids and bases are separated from each other, the bases are filled with a given quantity of pulverulent substance, the filled bases and the lids are again fitted together, and the filled and closed capsules are discharged. These operations are carried out in stations comprising the appropriate devices.

One of the critical operations in such machines is clearly the pulverulent substance dispensing, the accuracy of which can be influenced by the nature of the powder (for example its fluidity) and also by the environmental conditions under which the operation takes place (for example humidity and temperature).

In the machines described in U.S. Pat. No. 3,242,638, the problem of correct dispensing is confronted by choosing the powder formulation to give it constant characteristics, and by operating in a controlled environment.

The problem of correct dispensing is however different for other types of machines which can also operate or have to operate in uncontrolled environments, with limited production and with pulverulent products of differing characteristics, for which for obvious economical reasons the formulation cannot be adjusted.

Dispensing devices of different types have already been proposed with the intention of obtaining adequately accurate dispensing even in the case of limited production machines for operating in uncontrolled environments with pulverulent products of various characteristics.

Hetice for example, U.S. Pat. No. 1,876,813 comprises a continuously operated vertical screw which forces the pulverulent material through an exit aperture below which the capsule base is situated. This known device is simple, but results in material spillages (losses) even when no base is situated under the aperture and is also inaccurate as the screw throughput depends to a substantial extent on the powder level in the hopper in which the screw is located.

U.S. Pat. No. 1,993,716 comprises a hopper lowerly provided with two side pockets into which the powder is fed by a rotary star member. A piston in each pocket thrusts the powder into an underlying capsule base. Again in this known device the amount dispensed depends on the powder level in the hopper.

PCT W096/11658 comprises a hopper, an eccentric rotor in said hopper, a discharge aperture in said hopper, and a discharge aperture closable by a slide and provided in the hopper base. When in one position, this slide forms the movable wall of a chamber in which the powder arrives from said aperture, while when in another position it forms with the fixed part a hole into which the powder is compacted and within which a piston operates to discharge the powder into the underlying capsule base either directly or indirectly. This known device is difficult to set to provide given quantities of product as the slide position has to be regulated.

OBJECTS AND SUMMARY OF THE INVENTION

The dispensing device of the present invention aims to solve not only the problem of correct dispensing but also the problem of preventing losses of pulverulent material during the dispensing operations. These problems, and others which will be more apparent during the course of the present description, are solved by a dispensing device in accordance with the accompanying claims.

BRIEF DESCRIPTION OF THE DRAWINGS

The invention will be more apparent from the detailed description of a preferred embodiment thereof given hereinafter by way of non-limiting example and illustrated on the accompanying drawing, in which.

DETAILED DESCRIPTION OF THE PREFERRED EMBODIMENTS

Figure 1:
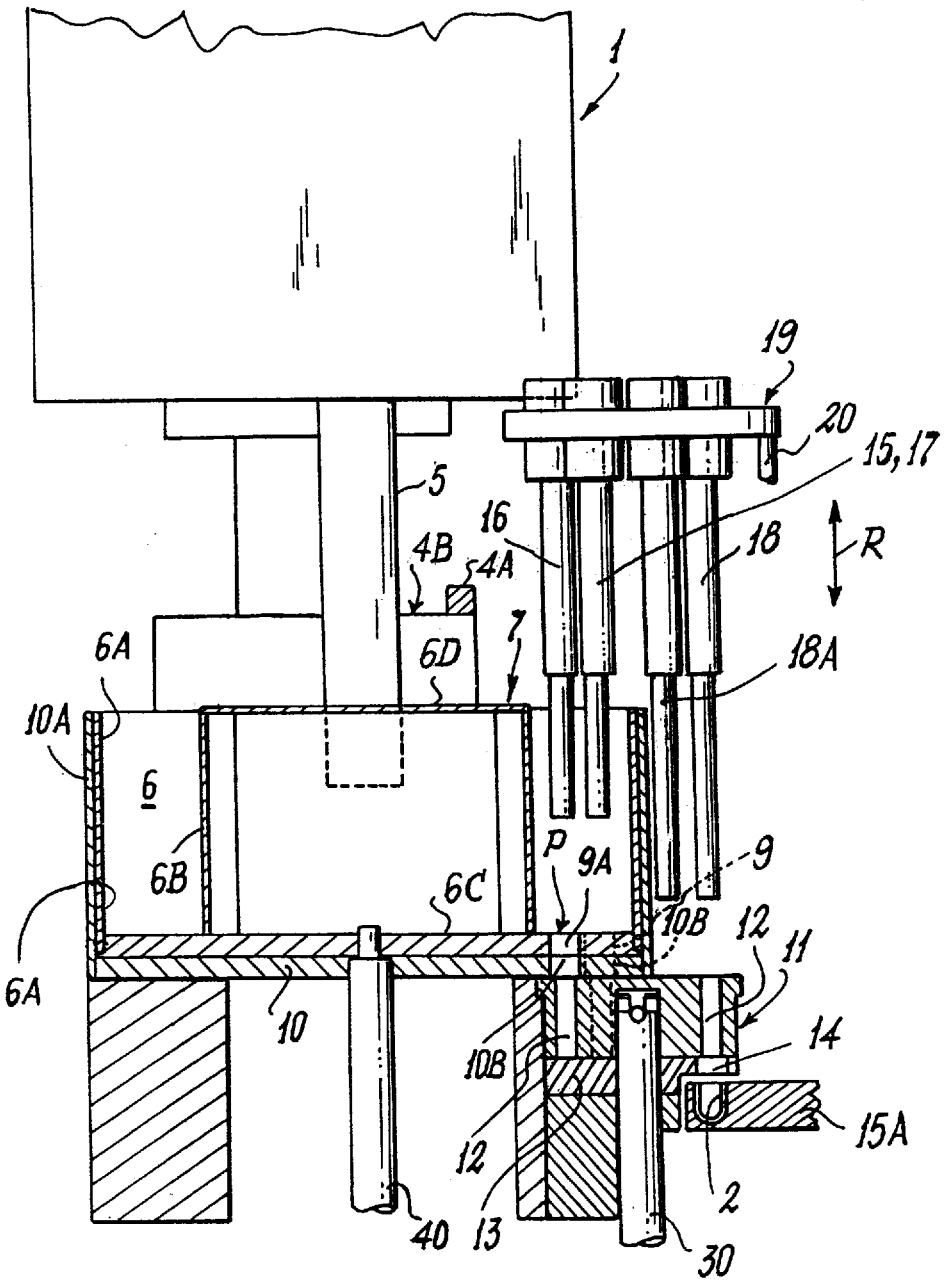
FIG. 1 is a schematic vertical section through the device of the invention.

In the figures, the reference numeral 1 indicates a stationary container containing the pulverulent material to be dispensed and fed into a capsule base 2. A feeder means, for example a conventional screw not shown, is mounted within the container and is driven by motor means, also not shown. The feeder means or screw feeds the pulverulent material to a discharge mouth 5 located and positioned in such a manner as to discharge the puverulent material in correspondence with a point of a circular channel 6 formed by an outer circular wall 6A, an inner circular wall 6B and a base 6C. The walls and base form part of a rotatable body 7 intermittently driven by a drive shaft 40, for example in the direction of the arrow F.

Downstream of the mouth 5 there is provided a stationary but possibly vertically adjustable scraper blade 4 which penetrates into the channel 6 to arrive substantially in contact with the channel base so that, as will be clarified hereinafter, the powder delivered by the mouth penetrates into holes 9, 9A present in the base of the channel 6.

By means of any known linkage, controlled for example by an adjustment knob, the vertical position of the scraper blade 4 can be adjusted, this in the example shown on the drawing being supported by an arm 4A carried by the device frame 4B.

In the base 6C of the circular channel 6 there is a series of groups X of three equal holes 9, 9A. These groups are angularly equidistant. The holes 9, 9A are arranged (FIG. 2) along two circles A and B concentric with the axis of the shaft 40. In the example six groups X are provided. The hole 9A of each group lies on the inner circle A, while the other two holes 9 lie on the outer circle B. The centres of the holes of each group X correspond to the vertices of an ideal triangle. Below the channel 6 and in contact with the relative base 6C there extends a fixed cover or closure plate 10 which is provided with a circular vertical wall 10A, and of which the purpose is to intercept said holes 9, 9A during the movement of the channelled body 7 except in three specific positions, indicated by P in FIG. 2, in which the plate 10 comprises holes 10B corresponding to the holes 9, 9A of the group X. A group of three holes 9, 9A of the channelled body 7 becomes aligned with and halts at the holes 10B at given times.

The circular wall 10A surrounds at a small distance therefrom the outer wall 6A of the channel 6, the inner wall 6B of the channel 6 being closed upperly by a plate or cover 6D. These expedients minimize pulverulent material dispersion which, besides representing uneconomical loss, can negatively affect the machine operation.

Below the channelled body 7 and partly projecting laterally from it there is provided a forming cylinder 11 which rotates intermittently by the movement transmitted to it by a shaft 30 with which it is rigid. The forming cylinder 11 has a series of equidistant sized through holes 12 arranged along a circle C concentric to the shaft 30.

Figure 2:
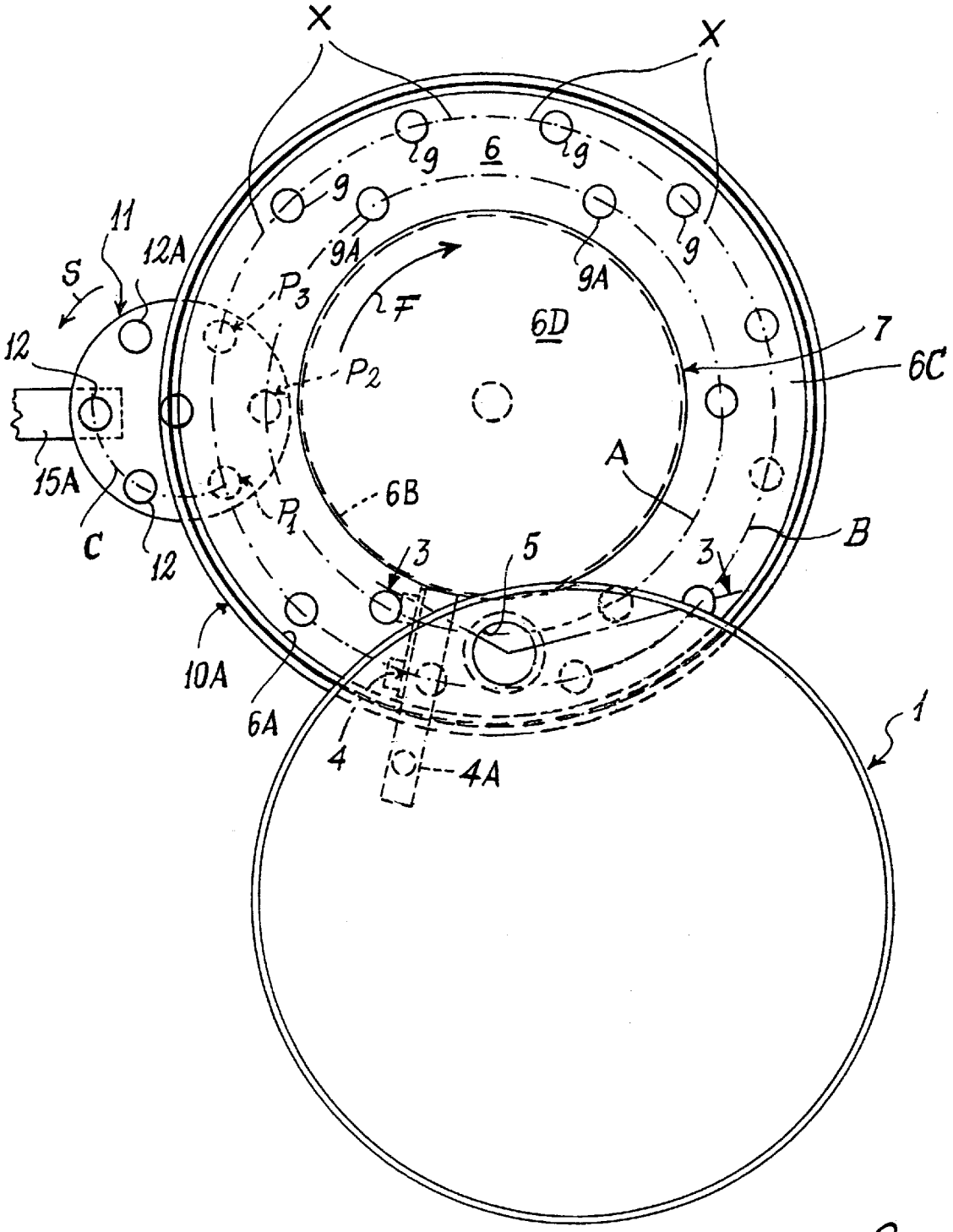
FIG. 2 is a schematic plan view of the device with parts omitted for clarity.
Figure 3:
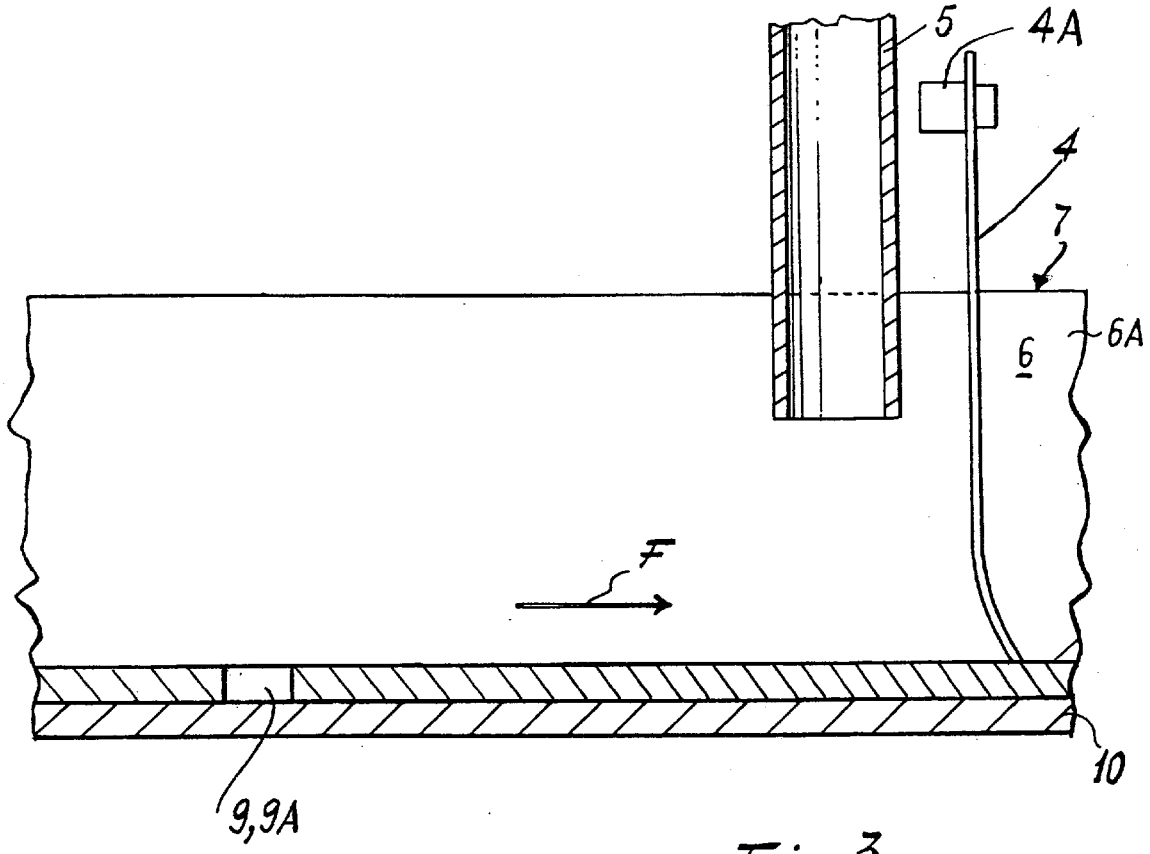
FIG. 3 is a schematic partial section on the line 3—3 of FIG. 2.
Figure 4:
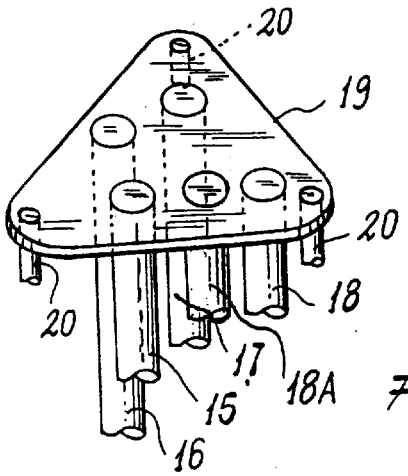
FIG. 4 is a schematic perspective view of the pusher members of the device.

In this example the holes 12 in the forming cylinder 11 are six in number, the position of the forming cylinder 11 and the movement transmitted to it being such that at each halt of both the channelled body 7 and the forming cylinder 11, a group X of three holes 9, 9A in the one are aligned with three holes 12 in the other, in the positions indicated by P in FIG. 2.

Below the forming cylinder 11 there is provided a stationary closure plate 13 the purpose of which is to prevent pulverulent product emerging from the holes 12 in the forming cylinder. The plate 13 is however provided with a single hole 14 coinciding with the point in which a measure of pulverulent product contained in the holes 12 of the forming cylinder 11 is transferred to the underlying capsule base 2, when a known movable means 15A carrying this base reaches the transfer position (FIG. 1), i.e., in alignment with the hole 14 and with one of the holes 12.

The means 15A carrying the capsule base 2 does not form part of the present invention and can be of the type described in the initially cited prior art. The movable means 15A moves the capsule bases 2 in succession into the transfer position of FIG. 1, in which a base 2 is made to halt for the time required for its filling, after which it is removed and replaced by others.

The intermittent movements of the channelled body 7 and forming cylinder 11, which are of opposite directions as shown by the arrows F and S, are synchronized and are obtainable by known mechanisms. For example the continuous motion of a drive shaft can be transferred to the shaft 30 of the forming cylinder 11 via a Maltese cross system, and be transferred to the shaft 40 of the channelled body 7 via a gear wheel pair. This transmission is not shown because of its obviousness. Said drive shaft can also transmit intermittent movement to the means 15A carrying the capsule base 2 again via a Maltese cross system, which can also have a different number of halts for each complete revolution. To transfer the pulverulent material from the holes 9, 9A of the channel 6 of the body 7 to the forming cylinder 11 and from this to the capsule base 2, pushers 15, 16, 17, 18 and 18A are used. Three of these, 15, 16, 17, are used for transferring the material into and compacting it within the holes 12 of the forming cylinder 11, and one, 18, is used for transferring the plug of pulverulent material from a hole 12 of the forming cylinder 11 into the capsule base 2. The fifth pusher 18A is used for the final compacting of the pulverulent material reaching the holes 12, to form a plug. This fifth pusher operates in that of the holes 12 which, with reference to the direction of rotation S of the forming cylinder 11, is at any given moment upstream of that hole 12 aligned with the base 2. The hole in which the pusher 18A operates is indicated by 12A in FIG. 2 to enable the aforegoing to be more easily understood.

The three pushers 15, 16, 17 are arranged in such a manner as to overlie and penetrate during halts into the vertically aligned holes present in the positions P or $P_1$, $P_2$, $P_3$ (FIG. 2) and pertaining to the base 6C (holes 9, 9A of a group X), to the stationary closure plate 10 (holes 10B), and to the forming cylinder 11 (holes 12) respectively. The fourth pusher 18, of greater length, which transfers the measure of compacted material into the underlying capsule 2, is arranged to penetrate into the hole 12 in the forming cylinder 11 and the hole 14 in the closure plate 13, these holes being aligned at given times with a capsule base 2. The fifth pusher 18A compacts the material (to form a plug) lying in the upstream hole 12A, as already stated.

The pushers are all supported by a movable cross-member 19. The pushers 15, 16, 17 are supported in such a manner as to be able to move axially against the action of springs. If desired, all the pushers can be adjusted vertically.

The cross-member is connected to the upper end of rods 20 which are connected together at their lower end by a further cross-member, not visible. This latter, for moving the pushers 15, 16, 17, 18, 18A in the direction of the arrows R of FIG. 1, can carry a roller which penetrates into a groove in a continuously rotating cam. The groove and the rotational speed of the cam are such as to cause the pushers to move to achieve said material transfers during the halt periods of the intermittently moving members (channelled body 7, forming cylinder 11, and the means 15 carrying the capsule base 2).

The three pushers 15, 16, 17 which transfer and compact the pulverulent material are, as already stated, situates in vertical alignment with the three holes 10B of the stationary closure plate 10 associated with the channelled body 7, whereas the fourth pusher 18 is situated in vertical alignment with the hole 14 of the closure plate 13 associated with the forming cylinder 11.

In FIG. 1 the pushers 15, 16, 17, 18, 18A are in their top dead centre position.

During halt periods, the capsule base 2, as shown in FIGS. 1 and 2, is in vertical alignment with the hole 12 of the forming cylinder 11, this hole being vertically aligned with the hole 14 of the closure plate 13. This hole 12 contains the required measure of pulverulent material in plug form. Again during halt periods, the transfer pusher 18 is vertically aligned with the holes 12, 14 and with the base 2. The three pushers 15, 16, 17 are in alignment with three holes 9, 9A of a group X which has reached position P, with the three holes 10B (located in position P) of the relative closure plate 10, and with three holes 12 (located in position P) of the forming cylinder, the pusher 18A being in alignment with the hole positioned at 12A.

The pushers 15, 16, 17, 18 and 18A are lowered together and the pusher 18A transfers the plug of material into the capsule base 2 while at the same time the pusher 15 transfers, with compression, a first quantity of pulverulent material into the underlying hole 12, i.e., that situated in position $P_1$, the pusher 16 transfers a quantity of powder (this quantity being added to a previous quantity loaded into the particular hole 12 when this was previously at rest in position $P_1$, and finally the third pusher 17 transfers with compression, into the hole 12 situated in $P_3$, a quantity of powder (this quantity being added to the two previous quantities which were loaded into the hole 12 when this was in the two preceding positions $P_1$ and $P_2$ on the occasion of the two previous halts).

With the described device, a first quantity of pulverulent material is loaded into and compressed within each hole 12 of the forming cylinder 11 which at each halt in its intermittent movement assumes the position $P_1$ (below the pusher 15), and when these holes reach the immediately following position $P_2$ (below the pusher 16) a second quantity of pulverulent material is loaded and compressed, followed by a third quantity when these holes reach the third position $P_3$ in which the third pusher 17 operates. When these holes 12 are then aligned with the capsule base 2 and with the pusher 18, the total quantity of pulverulent material loaded during the preceding three steps and finally compacted by the pusher 18A is transferred in the form of a plug into the capsule base.

For a still greater understanding of the aforegoing, it should be noted that each halt in the intermittent movements of the body 7 and forming cylinder 11 occurs, in the described example, after a 60° rotation of each of them, this signifying that after a 60° rotation of the body 7 in the direction of the arrow F, a new group X of three holes 9, 9A is brought into positions $P_1$, $P_2$, $P_3$, and after a simultaneous 60° rotation of the forming cylinder 11 a hole 12 situated in $P_1$ moves to $P_2$ and the hole in $P_2$ moves to $P_3$, whereas $P_1$ is taken by an empty hole 12, i.e., still to be filled. It is apparent that while in $P_1$ the hole 12 concerned receives a first quantity of material from the hole 9 of the group X which has reached position P ($P_1$, $P_2$, $P_3$). When the next group X reaches position P ($P_1$, $P_2$, $P_3$) and the hole 12 concerned reaches position $P_2$, this hole 12 receives (from the hole 9A) a second quantity of material. When the third group X reaches position P ($P_1$, $P_2$, $P_3$) and the hole 12 reaches position $P_3$, this hole 12 receives (from the other hole 9) a third quantity of material.

It is clear that the scope of the invention also covers embodiments in which both the holes 12 and the groups X can be other than six in number, the holes 12 and the groups X again being angularly equidistant such that the respective holes are superposed in positions $P_1$, $P_2$, $P_3$ during halts in their intermittent movement.

I claim:

1. A pulverulent substance dispensing device for capsule filling machines, provided with a container (1) for the pulverulent substance, an intermittently rotating channelled body (7) receiving the pulverulent substance from said container (1) and, cooperating therewith, an intermittently rotating forming cylinder (11) receiving measures of pulverulent substance from the channelled body (7) by first pusher means (15, 16, 17), these measures being transferred to a capsule base (2) by second pusher means (18), characterised in that the first pusher means comprise three pushers (15, 16, 17) arranged to cooperate simultaneously with sets of three aligned holes (9, 9A; 10B; 12, 12A) pertaining to a base (6C) of the channelled body (7), to a stationary closure plate (10) associated with the channelled body (7), and to the forming cylinder (11) respectively, the second pusher means (18) comprising a pusher which simultaneously transfers a plug of pulverulent material from a hole (12) in the forming cylinder (11) to the capsule base (2).

2. A device as claimed in claim 1, wherein the closure plate (10) associated with the channelled body (7) comprises a circular wall (10A) surrounding said channelled body (7).

3. A device as claimed in claim 1, wherein the channelled body (7) comprises a circular inner wall (6B) closed upperly by a discoidal wall (6D).

4. A device as claimed in claim 1, wherein the holes in the base of the channelled body (7) comprise groups (X) of three holes (9, 9A), two holes (9) of each group being arranged along a circle (A), the third holes (9A) being arranged in a circle (B) concentric with the preceding, the holes (9, 9A) of each group (X) being of triangular arrangement.

5. A device as claimed in claim 1, wherein within the channelled body (7) there is provided a scraper blade (4) positioned downstream of a material feed mouth (5) to substantially scrape against the base of the channelled body.

6. A device as claimed in claim 1, wherein a further pusher means (18A) is provided to act as a compactor for the material in that hole (12A) of the forming cylinder (11) situated upstream of the second pusher means (18).

7. A device as claimed in claim 1, wherein all the pusher means (15, 16, 17, 18) are connected together so that they move in unison.

* * * * *